US005894453A

United States Patent [19]

Pond

[11] Patent Number: 5,894,453

[45] Date of Patent: Apr. 13, 1999

[54] TOOTHBRUSH RECEPTACLE WITH TIMING DEVICE

[75] Inventor: Gary J. Pond, Racine, Wis.

[73] Assignee: Inter-Med, LLC., Racine, Wis.

[21] Appl. No.: 09/103,070

[22] Filed: Jun. 23, 1998

[51] Int. Cl.[6] ..... G04B 47/00; A46B 9/04

[52] U.S. Cl. ..... 368/10; 15/105; 15/167.1

[58] Field of Search ..... 368/10, 107–109; 15/105, 167.1; 132/309, 325; 601/141; 606/161

[56] References Cited

U.S. PATENT DOCUMENTS

| | | | |
|---|---|---|---|
| 3,783,364 | 1/1974 | Gallanis et al. | 320/2 |
| 4,788,734 | 12/1988 | Bauer . | |
| 4,836,415 | 6/1989 | Grussmark | 227/39 |
| 4,866,807 | 9/1989 | Kreit et al. . | |
| 5,044,037 | 9/1991 | Brown . | |
| 5,259,086 | 11/1993 | Fong . | |
| 5,438,726 | 8/1995 | Leite | 15/105 |
| 5,572,762 | 11/1996 | Scheiner . | |

FOREIGN PATENT DOCUMENTS

| | | |
|---|---|---|
| 3149233 | 4/1983 | Germany . |
| 3309687 | 9/1984 | Germany . |
| 2252234 | 5/1992 | Germany . |

*Primary Examiner*—Vit Miska
*Attorney, Agent, or Firm*—Ryan Kromholz & Manion, S.C.

[57] ABSTRACT

The toothbrush receptacle with timing device comprises a hollow body structure having a body opening at one end and a compartment provided adjacent to the other end for accommodating a timing device. The compartment has a compartment opening at the second end of the body structure. The toothbrush receptacle further comprises an exterior surface and an interior surface. The timing device comprises a switch mechanism, an energy source, an audio device and/or a visual sensor, and a timer. The toothbrush receptacle may comprise a sleeve consisting of a resilient material, such as rubber or vinyl, positioned and bonded within the hollow body structure and adjacent to the interior surface of the body structure.

20 Claims, 2 Drawing Sheets

TOOTHBRUSH RECEPTACLE WITH TIMING DEVICE

BACKGROUND OF THE INVENTION

The present invention relates generally to dental products and specifically to a toothbrush receptacle capable of holding a standard toothbrush and capable of alerting a user to stop brushing when sufficient time has elapsed. The present invention addresses the concern for an improved prophylactic dental care.

The human mouth is a continuous source of bacteria caused by fermentation of food residues that collect between teeth or at the gum line. The most widespread tooth diseases are cavities and parodontitis. Healthy nutrition and a proper oral hygiene are the most important factors in combating cavities and parodontitis. Required removal of food residues prevents a sharp increase in bacteria and consequently prevents cavities and irritation of the gums which gives rise to the risk of parodontitis. The goal of having a clean mouth and clean, healthy teeth can be accomplished only with a proper regimen of flossing and brushing. Dentists, dental hygienists, and other dental care professionals recommend thorough brushing at least twice a day, for at least two minutes. Surveys have produced results showing that most people do not time their brushing and, thus, do not brush for the suggested time period.

Several inventions and designs have addressed the issue of proper brushing. It has long been known in the prior art to provide toothbrushes equipped with some timing device, or signaling means. However, these toothbrushes appear to be economically unsatisfactory and more expensive than regular toothbrushes. Because these toothbrushes are periodically disposed of and replaced, the electrical components permanently housed within the handle must be suitable for such periodic disposal and replacement. In this regard, such electronic components tend to be inexpensive and thus, of relatively low quality. Such low quality devices tend to produce low quality sound reproductions which can be annoying to the user and may dissuade the user from using the toothbrush.

For example, U.S. Pat No. 5438,726 to Leite teaches a toothbrush with timer and signaling apparatus having interchangeable periodontal devices. The signaling apparatus is composed of both an audio and vibrating signaling device to alert the user when the preset time limit is achieved. U.S. Pat No. 5,572,762 to Scheiner teaches a sound generating toothbrush which has a sound generating apparatus and a switch device for activating the sound generating apparatus. The toothbrush has a handle portion with a compartment provided adjacent to the proximate end thereof for accommodating the sound generating apparatus and the switch device. The switch device has a push-button which is located at the proximate end of handle. Consequently, the sound generating apparatus can be activated, while normally holding the handle portion of the toothbrush, by momentarily pressing the proximate end of the toothbrush handle against any appropriate surface.

The present invention remedies this situation. The present invention allows consumers to use standard toothbrushes and still get the benefit of a timing device.

It is an object of this invention to provide a system which will improve dental care and the quality of brushing. It is further an object of this invention to provide such a system that is economical, safe, and easy to use. Still a further object of this invention is to provide a system which is reusable and can be coupled to standard toothbrushes.

SUMMARY OF THE INVENTION

The present invention relates to a system for timing the brushing of teeth and, more particularly, to a toothbrush receptacle for receiving the handle of a standard toothbrush and for alerting a user to stop brushing when sufficient time has elapsed.

The toothbrush receptacle with timing device comprises a hollow body structure having a body opening at one end and a compartment provided adjacent to a second end for accommodating a timing device. The compartment has a compartment opening at the second end of the hollow body structure. The toothbrush receptacle further comprises an exterior surface and an interior surface. The timing device comprises a switch mechanism, an energy source, an audio device and/or a visual sensor, and a timer. The toothbrush receptacle may comprise a sleeve consisting of a resilient material, such as rubber or vinyl, positioned and bonded within the hollow body structure and adjacent to the interior surface of the body structure. In an alternate embodiment, the toothbrush receptacle may comprise at least one annular member positioned and bonded within the body structure and adjacent to the interior surface of the body structure. A standard toothbrush handle may be inserted in the toothbrush receptacle where it is held secure by the sleeve or the annular member.

Just prior to the beginning of brushing, the user depresses the switch mechanism. This action starts the timer which counts a predetermined time period. During this time period, the audio device emits audible beeps, to signal that brushing must continue. At the end of the predetermined time period, the timer stops. The audio device emits a long audible beep. A visual sensor may be used in conjunction with the audio signal or in place of the audio signal. Similarly, the visual sensor illuminates to signal that the time period has elapsed, thus alerting the user to stop brushing.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figures 1, 2:
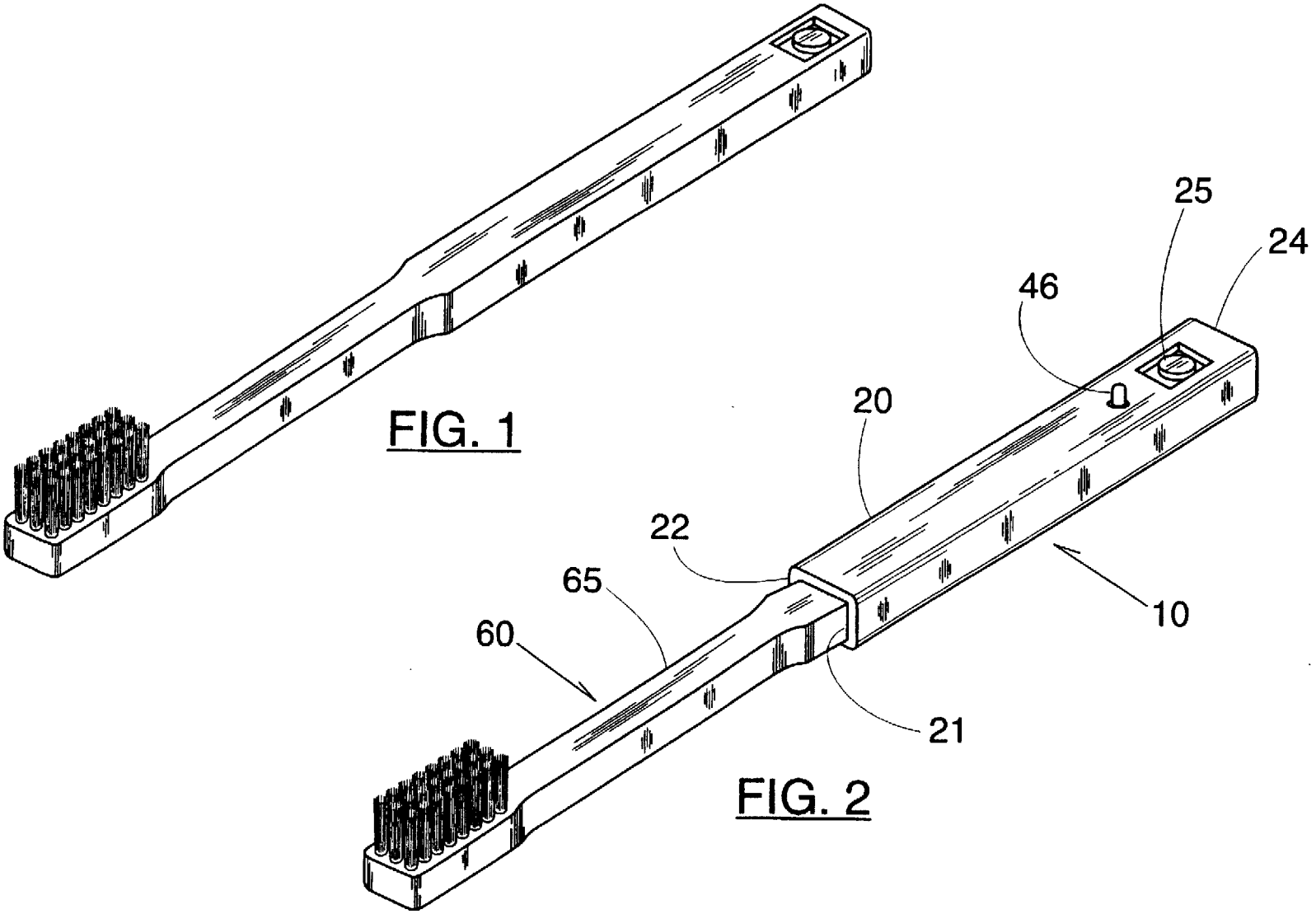
FIG. 1 is a perspective view of the prior art, showing a standard toothbrush provided with a timing device.
FIG. 2 is a perspective view of the invention, showing the toothbrush receptacle with timing device and a standard toothbrush inserted within the toothbrush receptacle.

The preferred embodiment of the toothbrush receptacle with timing device, designated generally as 10, is illustrated in FIG. 2.

Referring to FIG. 2, the toothbrush receptacle 10 includes a hollow body structure 20, having a first end 22 and a second end 24. The first end 22 of the body structure 20 has a body opening 21 formed therein, which allows the insertion of a handle 65 of a standard toothbrush 60 into the hollow body structure 20. The diameter of the body opening 21 on the first end 22 of the body structure 20 is only slightly larger that the diameter of the handle 65 of the toothbrush 60.

Figure 4:
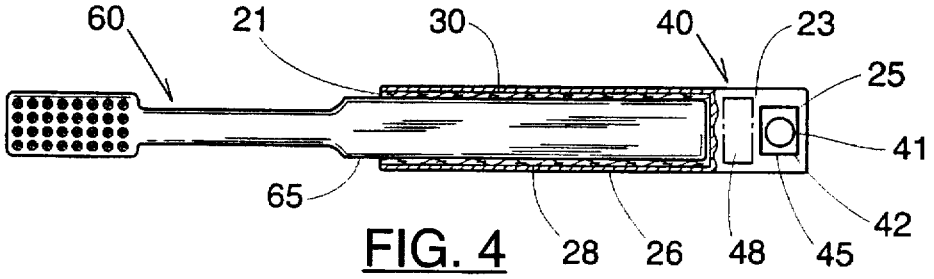
FIG. 4 is a cross-sectional view of the preferred embodiment of the invention.

Referring also to FIG. 4, the body structure 20 comprises an exterior surface 26 and an interior surface 28. Adjacent to the interior surface 28 is a sleeve 30, positioned and bonded within the body structure 20. Preferably, the sleeve 30 is made out of a resilient material, such as rubber or vinyl. This provides a friction or interference fit between the handle 65 of the toothbrush 60 and the toothbrush receptacle 10 and prevents the handle 65 from slipping out of the toothbrush receptacle 10 during the process of brushing.

As shown in FIG. 4, the body structure 20 further comprises a compartment 23 at the second end 24 of the body structure 20. The compartment 23 has a compartment opening 25 at the second end 24 of the body structure 20. A timing device 40 is positioned within the compartment 23 and adjacent to the second end 24 of the body structure 20. In the preferred embodiment, the timing device 40 comprises a switch mechanism 42, an audio device (not shown), an energy source 48, and a timer (not shown).

Figure 5:
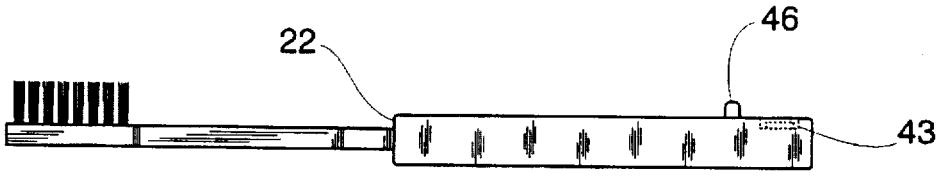
FIG. 5 is a side view of the invention showing the switch mechanism positioned on top of the toothbrush receptacle.
Figure 6:
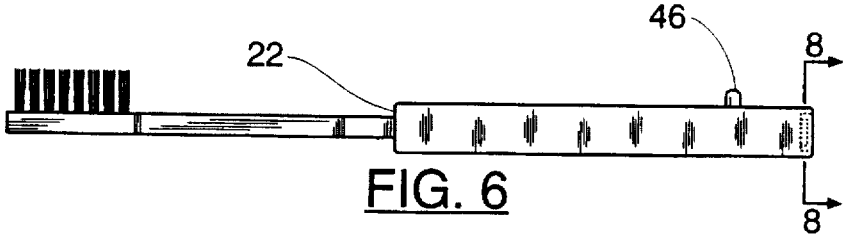
FIG. 6 is a side view of the invention showing the switch mechanism positioned at the second end of the toothbrush receptacle.
Figure 7:
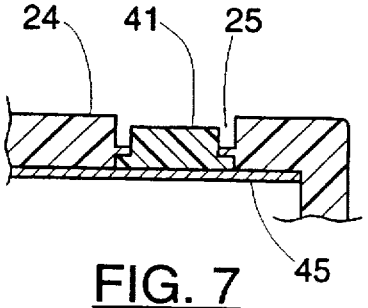
FIG. 7 is a cross-sectional view of the switch mechanism, taken along line 7—7 of FIG. 3.
Figure 8:
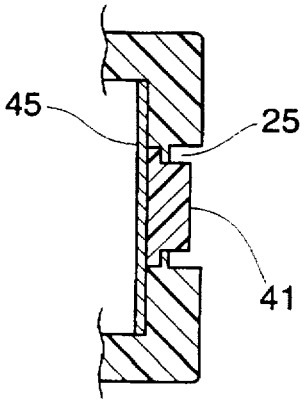
FIG. 8 is a cross-sectional view of an alternative embodiment of the switch mechanism, taken along line 8—8 of FIG. 6.

As shown in FIG. 2 and 5, the timing device 40 may further comprise a visual sensor 46 positioned on the exterior surface 26 of the body structure 20.

Referring back to FIG. 4, the switch mechanism 42 is positioned within the compartment 23 at the compartment opening 25. The switch mechanism 42 comprises a moveable push-button 41, an electronic switch member 43 and a water impermeable diaphragm 45. The moveable push-button 41 is positioned to protrude from said compartment opening 25 at the second end 24 of the body structure 20. The electronic switch member 43 is positioned within the compartment 23 and is coupled to the moveable push-button 41 for activating the audio device and/or the visual sensor 46. The water impermeable diaphragm 45 is positioned within the compartment 23, covering the electronic switch member 43 to prevent water damage to the timing device 40. The energy source 48 is positioned within the compartment 23 for providing electrical power to the timing device 40.

Figure 3:
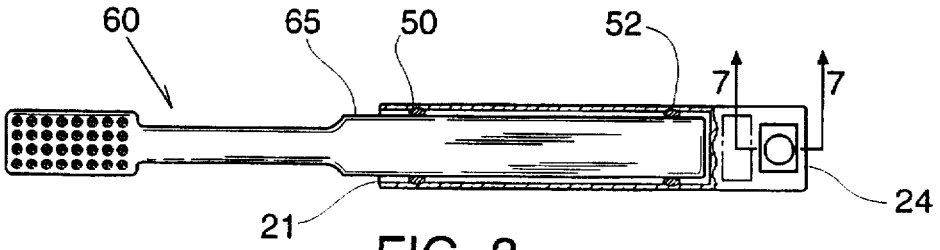
FIG. 3 is a cross-sectional view of an alternate embodiment of the invention.

Referring to FIG. 3, an alternate embodiment of the toothbrush receptacle 10 is shown. Instead of the sleeve 30, a first annular member 50 is positioned and bonded within the body structure 20 at its first end 22, adjacent to the interior surface 28 of the body structure 20. A second annular member 52 is provided and bonded within the body structure 20 at its second end 24, adjacent to the interior surface 28 of the body structure 20. The first annular member 50 and the second annular member 52 are made out of a resilient material, such as rubber or vinyl, to prevent the handle 65 from slipping out of the toothbrush receptacle 10 during brushing.

The present invention works as follows: First, the handle 65 of the toothbrush 60 is inserted into the toothbrush receptacle 10 through the body opening 21. When the handle 65 is secure inside the toothbrush receptacle 10, the sleeve 30 provides a friction fit with the handle 65 and prevents it from slipping out during brushing. Second, the push-button 41 of the switch mechanism 42 is depressed and the electronic switch member 43 activates the timer to start counting for a predetermined time period. During this time period, at predetermined set intervals, the timing device 40 emits an audible beep through the audio device to signal that brushing must continue. At the end of the predetermined time period, the timer stops counting and the timing device 40 emits a continuous beep through the audio device to signal that brushing must stop. Additionally or alternatively, the visual sensor 46 sends a visual signal, thus informing the user when the predetermined brushing period has elapsed.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A toothbrush receptacle for holding a handle of a toothbrush and for timing brushing, said toothbrush receptacle comprising:

a hollow body structure having a first end and a second end, and having an exterior surface and an interior surface;

said first end of said body structure having a body opening formed therein;

said body structure having a compartment at said second end;

said compartment having a compartment opening at said second end of said body structure;

a timing device provided within said compartment adjacent to said second end of said body structure; and a sleeve, said sleeve positioned within said body structure and adjacent to said interior surface of said body structure.

2. The toothbrush receptacle of claim 1, wherein said sleeve comprises a resilient material selected from a group consisting of rubber and vinyl.

3. The toothbrush receptacle of claim 1, wherein said timing device comprises:

an audio device positioned within said compartment adjacent to said second end of said body structure;

a switch mechanism coupled to said audio device for selectively activating said audio device;

said switch mechanism being disposed at said compartment opening of said second end of said body structure, having at least a portion which extends through said compartment opening and which is moveable to activate said audio device;

a timer provided within said compartment adjacent to said second end of said body structure, said timer coupled to said switch mechanism and said audio device.

4. The toothbrush receptacle of claim 1, wherein said timing device comprises:

a visual sensor, said visual sensor situated on said exterior surface of said body structure;

a switch mechanism coupled to said visual sensor for selectively activating said visual sensor;

said switch mechanism being disposed at said compartment opening of said second end of said body structure, having at least a portion which extends through said compartment opening and which is moveable to activate said visual sensor;

a timer provided within said compartment adjacent to said second end of said body structure, said timer coupled to said switch mechanism and said visual sensor.

5. The toothbrush receptacle of claim 1, wherein said timing device comprises:

an audio device positioned within said compartment adjacent to said second end of said body structure;

a visual sensor, said visual sensor situated on said exterior surface of said body structure;

a switch mechanism coupled to said audio device and said visual sensor for selectively activating said audio device and said visual sensor;

said switch mechanism being disposed at said compartment opening of said second end of said body structure, having at least a portion which extends through said compartment opening and which is moveable to activate said audio device and said visual sensor;

a timer provided within said compartment adjacent to said second end of said body structure, said timer coupled to said switch mechanism, said audio device, and said visual sensor.

6. The toothbrush receptacle of claim 3, wherein said switch mechanism comprises an electronic switch member and a water impermeable diaphragm covering said electronic switch member to prevent water damage to said audio device and said electronic switch member.

7. The toothbrush receptacle of claim 4, wherein said switch mechanism comprises an electronic switch member and a water impermeable diaphragm covering said electronic switch member to prevent water damage to said electronic switch member.

8. The toothbrush receptacle of claim 5, wherein said switch mechanism comprises an electronic switch member and a water impermeable diaphragm covering said electronic switch member to prevent water damage to said audio device and said electronic switch member.

9. The toothbrush receptacle of claim 6, wherein said switch mechanism has a moveable push-button for activation of said audio device and wherein said push-button is positioned to protrude from said compartment opening at said second end of said body structure.

10. The toothbrush receptacle of claim 7, wherein said switch mechanism has a moveable push-button for activation of said visual sensor and wherein said push-button is positioned to protrude from said compartment opening at said second end of said body structure.

11. The toothbrush receptacle of claim 8, wherein said switch mechanism has a moveable push-button for activation of said visual sensor and said audio device, and wherein said push-button is positioned to protrude from said compartment opening at said second end of said body structure.

12. The toothbrush receptacle of claim 1, further comprising an energy source positioned within said compartment adjacent to said second end of said body structure for providing electrical power to said timing device.

13. A toothbrush receptacle for holding a handle of a toothbrush and for timing brushing, said toothbrush receptacle comprising:

a hollow body structure having a first end and a second end, and having an exterior surface and an interior surface;

said first end of said body structure having a body opening formed therein;

said body structure having a compartment at said second end;

said compartment having a compartment opening at said second end of said body structure;

a timing device provided within said compartment adjacent to said second end of said body structure; and at least one annular member positioned within said body structure and adjacent to said interior surface of said body structure.

14. The toothbrush receptacle of claim 13, wherein said annular member comprises a resilient material selected from a group consisting of rubber and vinyl.

15. The toothbrush receptacle of claim 13, wherein said timing device comprises:

an audio device positioned within said compartment adjacent to said second end of said body structure;

a switch mechanism coupled to said audio device for selectively activating said audio device;

said switch mechanism being disposed at said compartment opening of said second end of said body structure, having at least a portion which extends through said compartment opening and which is moveable to activate said audio device;

a timer provided within said compartment adjacent to said second end of said body structure, said timer coupled to said switch mechanism and said audio device.

16. The toothbrush receptacle of claim 13, wherein said timing device comprises:

a visual sensor, said visual sensor situated on said exterior surface of said body structure;

a switch mechanism coupled to said visual sensor for selectively activating said visual sensor;

said switch mechanism being disposed at said compartment opening of said second end of said body structure, having at least a portion which extends through said compartment opening and which is moveable to activate said visual sensor;

a timer provided within said compartment adjacent to said second end of said body structure, said timer coupled to said switch mechanism and said visual sensor.

17. The toothbrush receptacle of claim 13, wherein said timing device comprises:

an audio device positioned within said compartment adjacent to said second end of said body structure;

a visual sensor, said visual sensor situated on said exterior surface of said body structure;

a switch mechanism coupled to said audio device and said visual sensor for selectively activating said audio device and said visual sensor;

said switch mechanism being disposed at said compartment opening of said second end of said body structure, having at least a portion which extends through said compartment opening and which is moveable to activate said audio device and said visual sensor;

a timer provided within said compartment adjacent to said second end of said body structure, said timer coupled to said switch mechanism, said audio device, and said visual sensor.

18. The toothbrush receptacle of claim 15, wherein said switch mechanism comprises an electronic switch member and a water impermeable diaphragm covering said electronic switch member to prevent water damage to said audio device and said electronic switch member.

19. The toothbrush receptacle of claim 16, wherein said switch mechanism comprises an electronic switch member and a water impermeable diaphragm covering said electronic switch member to prevent water damage to said electronic switch member.

20. The toothbrush receptacle of claim 17, wherein said switch mechanism comprises an electronic switch member and a water impermeable diaphragm covering said electronic switch member to prevent water damage to said audio device and said electronic switch member.

* * * * *